US006585606B2

(12) United States Patent
Penrose

(10) Patent No.: US 6,585,606 B2
(45) Date of Patent: Jul. 1, 2003

(54) GOLF CLUB ACCESSORY

(76) Inventor: Thomas S. Penrose, 116-5th St., Jupiter, FL (US) 33458

( * ) Notice: Subject to any disclaimer, the term of this patent is extended or adjusted under 35 U.S.C. 154(b) by 0 days.

(21) Appl. No.: 09/905,302

(22) Filed: Jul. 16, 2001

(65) Prior Publication Data

US 2003/0013540 A1 Jan. 16, 2003

(51) Int. Cl.[7] ..... A63B 53/00
(52) U.S. Cl. ..... 473/284
(58) Field of Search ..... 473/282, 283, 473/284, 285, 286, 386, 300, 301, 302, 303; 294/19.1

(56) References Cited

U.S. PATENT DOCUMENTS 2,154,989 A * 4/1939 Moore
3,698,720 A * 10/1972 Gudmundsen
4,951,947 A 8/1990 Kopfle
5,011,150 A 4/1991 Averill
5,672,121 A 9/1997 Miller
5,690,558 A * 11/1997 Huber
5,842,933 A * 12/1998 Lewis
6,190,265 B1 * 2/2001 Schmitt

* cited by examiner

*Primary Examiner*—Stephen Blau
(74) *Attorney, Agent, or Firm*—McHale & Slavin, P.A.

(57) ABSTRACT

A golf club accessory for retrieving golf tees has a fastener for attaching the accessory to the handle end of the golf club shaft. The accessory has a base approximating the configuration of the butt end of the golf club handle. The fastener is on one side of the base and flexible, resilient fingers extend outwardly in the axis of the shaft from the other side. The accessory may be integrally molded, mounted, formed or otherwise incorporated into the golf club grip. After striking the ball, the club is reversed and the golf tee is captured by the fingers without the necessity of the golfer bending his back.

3 Claims, 4 Drawing Sheets

GOLF CLUB ACCESSORY

FIELD OF THE INVENTION

This invention relates generally to golf and more particularly to a golf club accessory for use in the retrieval of a golf tee.

BACKGROUND INFORMATION

The game of golf is an immensely popular sporting activity played throughout the world. In the most simplified form, the game is played on a golf course consisting of eighteen holes, each hole having a tee, a fairway, and a putting green. A skill is required by avoiding sand traps, water hazards, and roughs. The premise of the game requires ball control for purposes of completing a round of golf in as few strokes as possible. The game of golf employs the use of various clubs that provide the golfer with tools to control distances that a golf ball is advanced. For instance, when a golfer puts a ball into play for a particular hole, the golfer must strike the ball from a tee surface in hopes of placing the ball within a hole located on a distant putting green. If the length of distance between the tee surface and the putting green is long, the golfer may typically employ a club historically called a "wood" or "driver" to project the ball as far as possible toward the putting green. The rules of the game allow the golfer to place the golf ball upon a golf ball tee for this initial tee off. The golf ball tee may be used on each of the eighteen holes.

Unique to the game of golf is the ability for any age individual to compete and enjoy the game. The use of a handicap system allows an individual, despite their ability and skill to compete with fellow golfers. In light of this, elderly persons and those with minor physical ailments can fully enjoy and compete in the game, even if they have difficulty in bending over which is a necessary function for placement and retrieval of golf balls and golf tees. For instance, once a golfer has hit a golf ball from the tee, the need to retrieve the golf ball tee is required. However, many individuals are too lazy or simply choose not to bend over due to the inconvenience or physical limitations. The result is discarded golf tees laying on the tee playing surface. This leaves an unsightly playing surface and can be hazardous to maintenance people and equipment, for example mowers which are employed to provide a short grass on the tee surface.

If an aluminum tee is used, the discarded tee can actually damage reel mowers. Typically the tees are very inexpensive and if the tee is not in a convenient position to pick-up, the tee is abandoned by the golfer. Further, very seldom will a golfer pick-up a spent tee left by another golfer.

For these reasons there exists a need for a low cost device that will assist a golfer in the retrieval of a golf tee, and make it so convenient that they may pick up other discarded tees.

DESCRIPTION OF THE PRIOR ART

U.S. Pat. No. 5,011,150 discloses a golf tee retrieval system consisting of a hook and loop system coupled to a golf tee and the end of the shaft of a golfclub. The inventor employs the hook and loop system by placing a piece of the "Velcro" on the tee and the mating portion on the end of the golfclub shaft. A golfer would utilize the golfclub in its ordinary and conventional manner and after striking a golf ball would invert the golfclub and press the hook and loop system together for purposes of retrieving the golf tee. A disadvantage to such a system is that the golf tee is typically laying on its side and thus the placement of the hook and loop on the end of a tee makes it impractical for ball retrieval. In addition, placing of the material on top of the tee can offset the golf ball wherein even a wind could cause the golf ball to become dislodged from the tee.

U.S. Pat. No. 2,154,989 discloses an attachment for golf clubs that sits on the end of a golf club shaft and employs semi-circular hoops for purposes for engaging the golf tee. This device requires the golfer to manipulate the tee through the holes requiring a developed skill in order to use the golf tee retrieval.

U.S. Pat. No. 5,672,121 discloses an apparatus for positioning and retrieving of golf balls and tees. This invention employs a separate apparatus that is used independent of a golf club thus requiring additional items to be placed in a golf club bag. In addition, this device uses an elaborate retrieval having mechanical parts that can be easily damaged by placement in a bag especially should the bags be filled with graphite shafts easily scratched or otherwise damaged when unrelated items are placed into the golfbag.

U.S. Pat. No. 4,951,947 discloses yet another golf ball teeing device which further allows for retrieval of a golf tee if the golf tee remains in an upright position. This item would be impractical for most golfers that drive a golf ball because the tee is laying in a horizontal position. In addition this requires the use of a separate utensil again placed within a golf bag.

SUMMARY OF THE INVENTION

The present invention satisfies this need through provision of a golf club accessory device that is used in combination with a golf club. The device has a base with a top side surface and a bottom side surface. The top side surface has at least two spaced-apart flexible members used for capturing a golf tee. The base is secured to the handle end of a golf club shaft whereby the golf club can be used for its intended purpose of striking a golf ball from a tee. The accessory device or flexible fingers may be molded, mounted or otherwise incorporated into the grip of the golf club. The flexible members are used to retrieve a golf ball tee by inverting the golf club shaft, allowing the shaft to operate as an arm extension allowing tee retrieval without the need for the golfer to bend over.

It is an objective of the invention to provide a golf tee retrieval device that is easy and economical to use in conjunction with a conventional golf club which will facilitate the retrieval of a golf tee when laying on the ground.

Another objective of the instant invention is to disclose a golf club accessory that is inexpensive and can be readily discarded after excessive use.

Still another objective of the instant invention is to make the retrieval of golf tees more simplistic whereby an individual would be more likely to pick up golf tees discarded by other golfers.

Still another objective of the instant invention is to provide a golf club accessory that does not inhibit the use of a golf club in its ordinary and conventional manner and further provides a spacer when placed in a golf bag to prevent moisture or other debris from attaching to the end of the golf club grip thereby preventing the golfer's hand from touching items that may have otherwise contacted the tip of the handgrip.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION

Golf clubs are made with an elongated flexible shaft of steel, fiberglass, graphite or other material. At one end of the shaft a head is attached. The head which may be of steel, titanium or other exotic combinations of materials, is the component of the golf club that strikes the golf ball. At the other end of the shaft is the handle which is grasped in the hands of the golfer. This handle end of the club usually has an outer grip made of some material, e.g. leather or rubber, which facilitates the intimate contact between the golfer's hands and the club.

Figure 1:
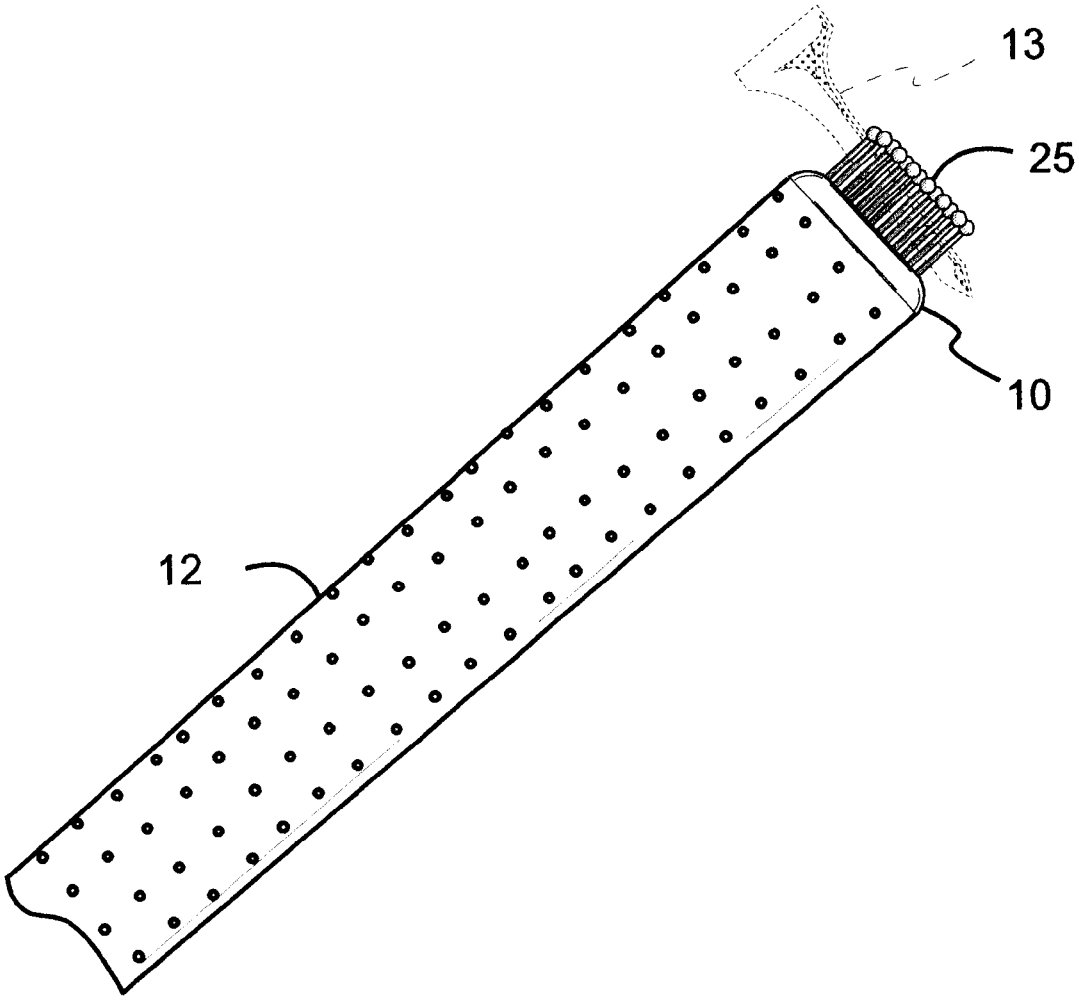
FIG. 1 is a perspective of a golf club handle and tee retriever of this invention grasping a tee shown in phantom lines.

The tee retriever 10, or fingers 25, shown in FIG. 1, may be molded, mounted or otherwise incorporated on the handle end of a golf club shaft (not shown) or likewise included in the grip 12. The grip 12 has a hollow tubular body which tightly surrounds the handle of the club and is usually secured in place by adhesive between the grip and handle. The tee retriever 10 is mounted on the butt end of the grip 12 and has a plurality of resilient and flexible fingers 25 (shown in FIG. 2A), the free ends of which are spaced-apart from each other a distance which is less than the diameter of the golf tee 13. The tee 13 is held in the resilient grasp of the fingers which are forced apart by the body of the tee. The length of the fingers 25 is at least equal to the diameter of the largest portion of the tee. The tee retriever 10 has a base 21 sized and shaped to approximate the dimensions of the butt end of the grip 12. The base has a bottom surface 44*a* (shown in FIG. 4) which contacts and is fastened to the grip 12. The top side surface of the base 21 carries the fingers 25.

As shown in FIG. 1, the grip 12 and retriever 10, or flexible fingers 25, may be molded or otherwise formed as an integral component for the golf club. Also, the retriever may be included with new grips by placing the base between the ends of the shafts and the tubular ends of the grips so that the mounted grips hold the retrievers in place.

Figure 2A:
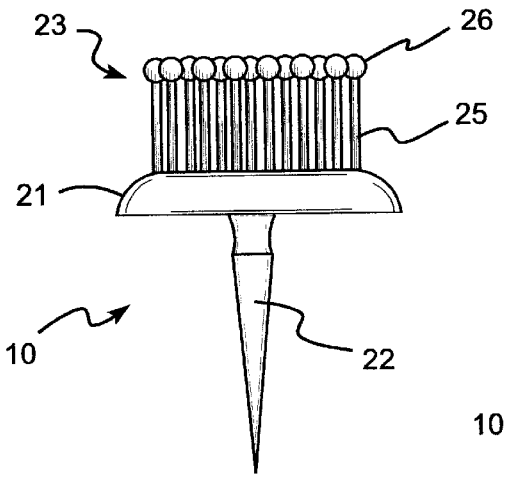
FIG. 2A is a perspective of the tee retriever showing a spike fastening embodiment.

FIG. 2A shows a tee retriever 23 having a base 21 supporting resilient flexible fingers 25. The free ends of the fingers carry enlargements 26 shown as spherical, though other shapes can be used. The enlargements 26 operate to prevent the tee from escaping from the retriever due to the resilience of the fingers. The bottom surface of the base 21 has a spike 22 for fastening the retriever to the grip and handle of the golf club. When the spike 22 is driven into the end of the grip and shaft, it is frictionally held in place. The fingers 25 extend outwardly parallel to the axis of the shaft and do not interfere with the normal use of the club.

Figure 2B:
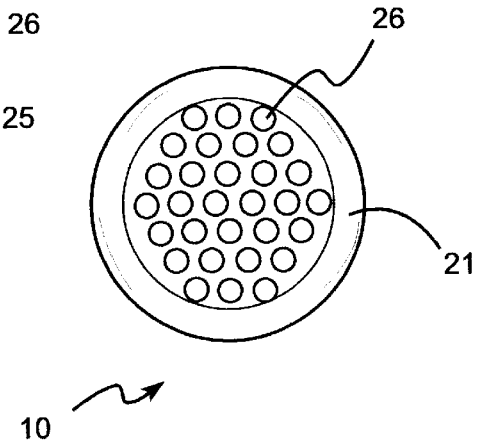
FIG. 2B is a top view of the tee retriever of this invention.

FIG. 2B shows a typical orientation of the fingers within the periphery of the base 21. As shown, the enlargements 26 are not in contact with each other, however, such an arrangement is possible.

Figure 3A:
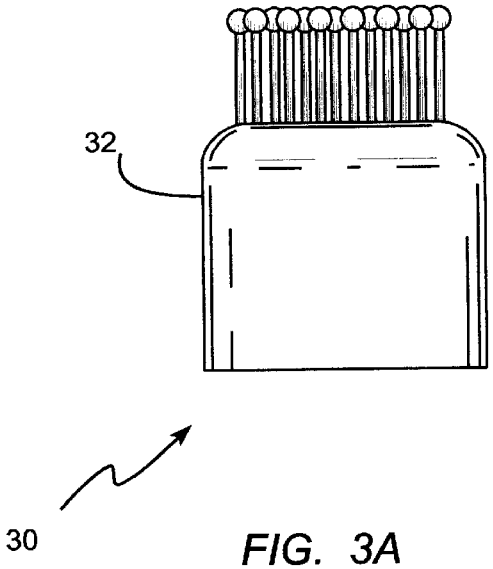
FIG. 3A is a perspective of a golf club grip and integral tee retriever.
Figure 3B:
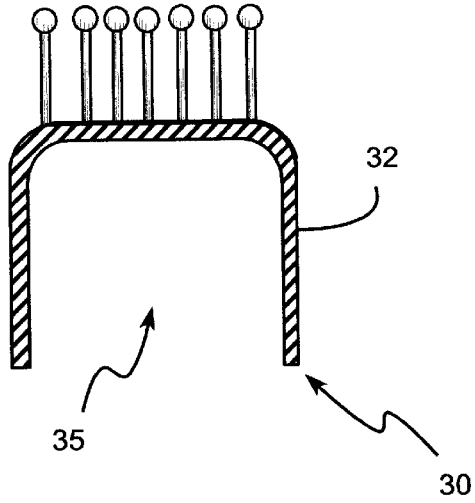
FIG. 3B is a cross-section of a tee retriever showing a tubular fastening embodiment.

FIG. 3A shows another embodiment 30 of the retriever in which the fingers 25 are integrally molded into the butt end of the grip. The tubular extension of the grip is placed over the handle of the golf club in the conventional manner. FIG. 3B shows the retriever as an add-on with the accessory base 32 formed as a tubular extension 35 to fit over the butt end of the golf club grip and handle.

Figure 4:
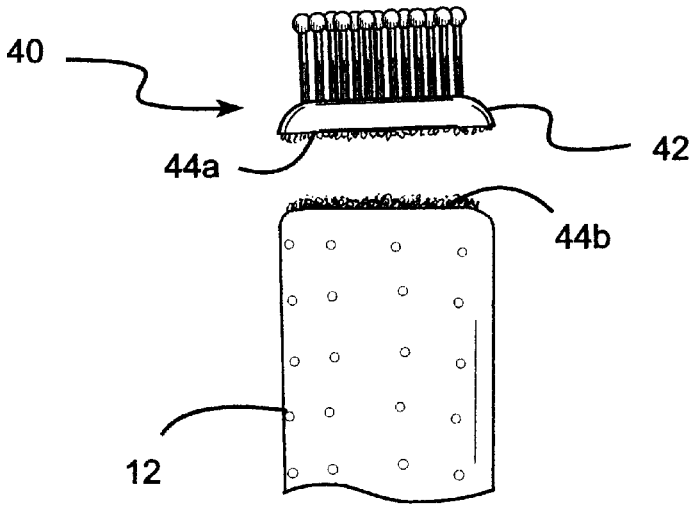
FIG. 4 is a perspective of the tee retriever showing a "Velcro" fastening embodiment.

In FIG. 4, the retriever embodiment 40 has a hook and loop, "Velcro," material affixed to the bottom surface 44*a* of base 42. A complimentary strip 44*b* of "Velcro" is affixed to the butt end of the grip 12. When the "Velcro" strips are mated, the retriever 40 is fastened to the grip 12.

Figure 5:
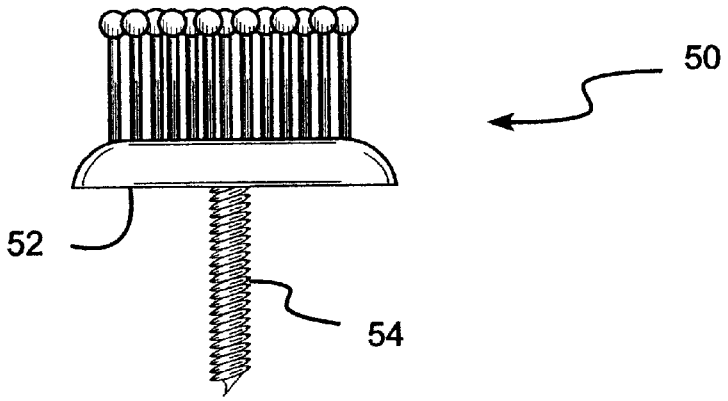
FIG. 5 is a perspective of the tee retriever showing a screw fastening embodiment.

FIG. 5 shows another retriever embodiment 50 with a threaded screw 54 extending from the bottom surface 52 of the base. The use of the threaded screw between the retriever and the shaft provides a more positive connection.

Figure 6:
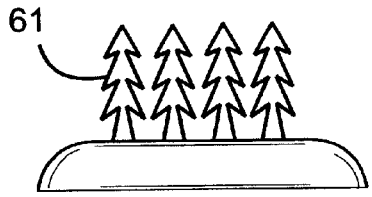
FIG. 6 is a side view of another embodiment of the fingers of this invention.

In FIGS. 6–11, various shapes of the fingers are illustrated. Each of the embodiments have structural elements which frictionally engage the golf tee and retain it until removed by the golfer. For example, FIG. 6 shows arrow head fingers 61 that facilitates the capture of a discarded tee by movement in one direction yet prevents the tee from freely escaping. This allows the tee to be picked up off the ground and brought to the up-right position of the golfer.

Figure 7:
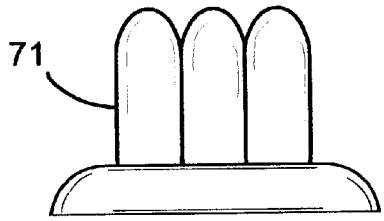
FIG. 7 is a side view of another embodiment of the finger of this invention.

FIG. 7 shows a plurality of cylindrical fingers 71 with rounded free ends. The cylindrical sides of several fingers simultaneously grip the length of the tee.

Figure 8:
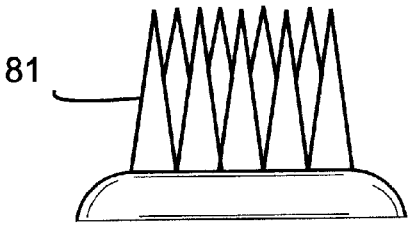
FIG. 8 is a side view of another embodiment of the fingers of this invention.

FIG. 8 shows conical or pyramidal fingers 81 wherein the bases of the projections overlap and grasp the tee.

Figure 9:
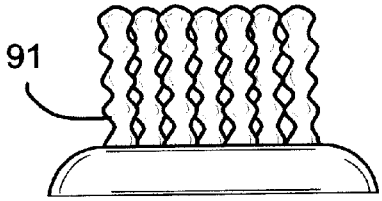
FIG. 9 is a side view of another embodiment of the fingers of this invention.

FIG. 9 shows another form of columnar fingers 91 with varying circumferences along the length of each column. The overlapping enlarged circumferential areas hold the tee.

Figure 10:
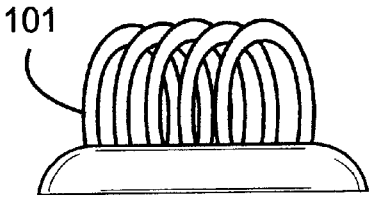
FIG. 10 is a side view of another embodiment of the fingers of this invention.

FIG. 10 shows fingers formed as semi-loops 101. The ends of the semi-loops 101 are attached to the base with the curved intermediate portions forming the free ends of the fingers. The semi-loops are closer together than the diameter of a tee.

Figure 11:
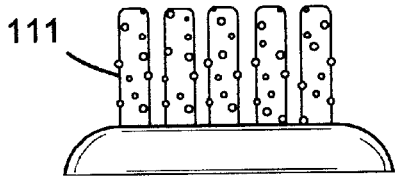
FIG. 11 is a side view of another embodiment of the fingers of this invention.

FIG. 11 shows cylindrical fingers with a series of projections spaced about the entire circumferential surface 111.

The retriever may be made of plastics or metals or combinations thereof which have the requisite properties of lightness, flexibility and resiliency. They may be made in one piece or components which are subsequently assembled.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim is:

1. A golf accessory device to be mounted on a golf club for retrieving golf tees, said golf club including an elongated shaft with a handle end, said device comprising:

a base having a top side surface, a bottom side surface, and a periphery between said top side surface and a said bottom side surface, said top side surface having more than two spaced apart flexible, resilient fingers extending therefrom, said fingers each attached to said base;

said resilient fingers extending from and raised above said top side surface and spaced from each other a distance less than the diameter of a golf tee;

said bottom side surface having a fastener for connecting said device to the handle end of a golf club shaft, said fastener selected from the group consisting of a spike, a screw, hook and loop fabric, adhesive, and a tubular extension or a golf club grip;

whereby the golf club can be used for its intended purpose and by reversing the golf club shaft, said flexible, resilient fingers of said base are used to retrieve a golf ball tee.

2. A golf club accessory device according to claim 1 wherein said resilient fingers have a structure selected from the group consisting of rods with a spherical end, rods with arrow head ends, cylindrical rods with rounded ends, columnar rods with varying circumference, pyramidal rods, and semi-loops.

3. A golf accessory device to be mounted on a golf club for retrieving golf tees, said golf club including an elongated shaft with a handle end, said device comprising:

a base having a top side surface and a bottom side surface, said top side surface having at least two spaced apart flexible, resilient fingers extending therefrom, said fingers each having a free end and another end connected to said base;

said resilient fingers raised above said periphery of said top side surface and spaced from each other a distance less than the diameter of a golf tee, said resilient fingers having spherical free ends;

said bottom side surface having a fastener for connecting said device to the handle end of a golf club shaft, said fastener in the form of a spike;

whereby the golf club can be used for its intended purpose and by reversing the golf club shaft, said flexible, resilient fingers of said base are used to retrieve a golf ball tee.

* * * * *